US005242525A

United States Patent [19]

Biagiotti

[11] Patent Number: 5,242,525

[45] Date of Patent: Sep. 7, 1993

[54] APPARATUS FOR GLUEING THE TAIL OF LOGS OF WEB MATERIAL

[75] Inventor: Guglielmo Biagiotti, Capannori, Italy

[73] Assignee: Fabio Perim S.p.A., Lucca, Italy

[21] Appl. No.: 967,443

[22] Filed: Oct. 28, 1992

[30] Foreign Application Priority Data

Nov. 8, 1991 [IT] Italy ..... 267 A/91

[51] Int. Cl.[5] ..... B05B 1/00; B65H 27/00; B65H 81/00

[52] U.S. Cl. ..... 156/357; 156/361; 156/446; 156/455; 156/184; 156/578; 156/456; 156/450; 242/56 R; 242/66

[58] Field of Search ..... 156/187, 602, 456, 578, 156/410, 356, 357, 184, 446, 425, 448, 449, 450; 242/58.1, 58.2, 56 R, 58, 66

[56] References Cited

U.S. PATENT DOCUMENTS

| | | | |
|---|---|---|---|
| 3,044,532 | 7/1962 | Ghisoni | 156/361 |
| 3,134,706 | 5/1964 | Alexander | 156/357 |
| 3,393,105 | 7/1968 | Tellier | 156/357 X |
| 3,440,116 | 4/1969 | Whitecar | 156/445 X |
| 3,533,055 | 1/1971 | Janik | 156/450 |
| 4,299,642 | 10/1981 | Berkholtz | 156/191 |
| 4,475,974 | 10/1984 | Perini | 156/456 X |
| 4,693,766 | 9/1987 | Stauffer | 156/357 X |
| 4,931,130 | 6/1990 | Biagiotti | 156/184 X |
| 5,045,140 | 9/1991 | Dickey | 156/448 X |
| 5,137,225 | 8/1992 | Biagiotti | 242/66 |

FOREIGN PATENT DOCUMENTS

| | | | |
|---|---|---|---|
| 2036992 | 2/1971 | Fed. Rep. of Germany | 156/357 |
| 2434359 | 3/1976 | Fed. Rep. of Germany | 156/357 |

*Primary Examiner*—David A. Simmons
*Assistant Examiner*—Charles E. Rainwater
*Attorney, Agent, or Firm*—Francis J. Bouda

[57] ABSTRACT

The glueing apparatus includes a pair of endless conveyor members (13, 15) whose active branches (13A, 15A) are parallel, with one superimposed above the other and spaced apart to an extent corresponding to the diameter of the rolls or logs (R) and moving in the same direction whereby to move the log forward. The upper active branch (15A) extends further than the lower active branch (13A). Unwind mechanism (31) for unwinding the tail (L) of the material of the log (R) is located upstream of the lower endless conveyor member (13) and controlled by an optical sensor which checks the length of said tail. Downstream of the lower endless conveyor member (13) a glue dispenser (58) dispenses glue from below onto the outer surface of the log. A subsequent rewinding station (R) is located downstream of the lower continuous conveyor member (13).

9 Claims, 8 Drawing Sheets

APPARATUS FOR GLUEING THE TAIL OF LOGS OF WEB MATERIAL

BACKGROUND OF THE INVENTION

The object of the invention is to provide an apparatus for glueing the tail of a web of material forming a roll or log. It includes means for unwinding the tail of the material wound up to form a log; means for detecting the end of said tail; means for applying glue on the web material whereby said glue serves to glue the end of the tail onto the log; means for rewinding the log and glueing the tail thereon; and means for transporting said log.

Apparatuses of this general type are described, for example, in U.S. Pat. No. 4,475,974 and U.S. Pat. No. 4,931,130. In the Italian Patent Application 9504 A/90 and in the corresponding foreign applications (among them the EP Application No. 91830427.0, Publication No. 0481923), a machine is disclosed working according to a novel principle. The latter does not provide a nozzle crossing the machine and spreading a layer of glue onto the unwound tail edge of the log, nor for the same log to be rewound afterwards, but it provides for rolling the log with its tail edge open over a slit which dispenses glue in small amounts so as to lay down a strip of glue onto the periphery thereof in a region very close to the point where the end part of the tail edge will drop after the rewinding. In this embodiment, flexible means are provided which support cradles for receiving logs to be glued with each roll or log being lifted by means of the flexible member after having unwound the tail of the log at a first station. The tail of the web is laid down onto a flat surface combined with means for controlling the length of said tail, which means control the rewinding of said tail until it reaches a predetermined residual length.

The invention relates to an apparatus of the above-mentioned type, which makes it possible to obtain remarkable advantages, among which are:

better control of the log during glueing thereof,
reduced number of moving elements,
reduced speed of translating elements,
more compact and economical construction.

These and other objects and advantages will be apparent from a reading of the following description.

DESCRIPTION OF THE INVENTION

The apparatus according to the invention includes a pair of endless conveyor members whose active branches are substantially parallel (possibly slightly converging) and superimposed to each other, spaced apart to an extent slightly less than the mean diameter of the rolls or logs, and advancing in the same direction for transporting the log. The upper active branch starts just before the lower active branch and extends further than the latter as far as above the glue dispenser. Means for unwinding the tail of the material of the log is located upstream of said lower endless conveyor member. An optical sensor controls the length of said tail. Downstream of said lower endless conveyor member is a glue dispenser device, dispensing glue from below onto the outer surface of the log. There follows a rewinding station.

In order to handle logs of different diameters, the apparatus advantageously includes means for adjusting the distance between the active branches of the pair of endless conveyor members. In particular, a unit may be provided which supports the upper endless conveyor member, which unit is borne by flexible chain means or the like, which moves the upper endless conveyor member parallel to itself. Spring systems or other counterweights may be provided for reducing the weight of said unit so as to accommodate the transit of logs which may vary slightly in diameter.

The two endless conveyor members are operated with continuous motion at constant speed; the lower one being moved slightly faster at an adjustable differential speed to achieve a controlled length of the unwound tail edge so as to apply the strip of glue in the desired position on the end of said tail with respect to the end edge thereof.

In a practical embodiment, the means for unwinding the tail includes disks disposed in a position slightly upstream of the active branch of the lower conveyor member, against which disks the log (which is rolling forward) is brought to a stop by coming into contact with the upper conveyor member. The unwinding means also includes means for driving said disks into rotation in a direction which causes the logs to rotate and rewind the tail. Blow nozzles are provided for unwinding said tail upon the arrival of said log. The above-mentioned tail edge detecting systems which control the stopping of rotation of said disks at the desired moment are a part of the embodiment.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
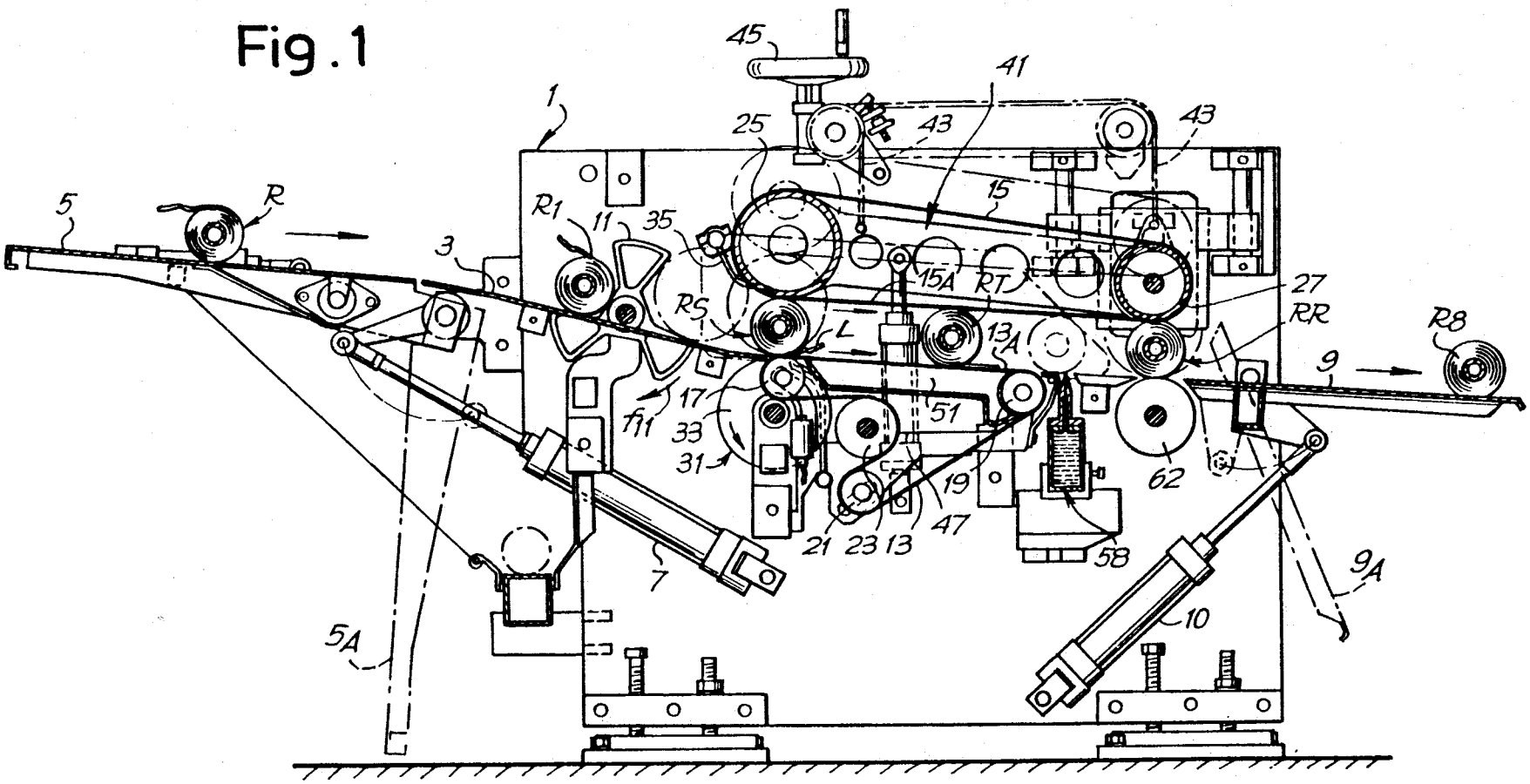
FIG. 1 shows a longitudinal vertical section of the glueing apparatus of the present invention.

Referring first to FIGS. 1 to 5, numeral 1 indicates a main frame having a transport surface 3 by way of which logs R reach the standby position R1 of the machine. The logs come from an inclined plane 5 that may be moved into position (and rapidly lowered back to position 5A) by a jack 7. Numeral 9 indicates an inclined plane on which the logs exit after their tail has been glued. An outgoing log is indicated at position R8. The inclined plane 9 is able to be lowered (by a jack 10) to position 9A. The positions 7A and 9A allow for easy servicing.

Numeral 11 indicates a star-shaped rotor which controls the supply frequency of the logs from position R1. The logs are transferred one at a time by the rotor (intermittently turning in the direction f11) to the operating area of the machine.

In this operating area, two endless conveyor belts are provided, a lower one 13 and an upper one 15, having respective active branches 13A and 15A extending slightly inclined to the horizontal, almost parallel to each other or slightly convergent, and spaced apart by an extent just less than the diameter of the rolls or logs R being processed. The active branch 13A extends between a front transmission roller 17 and a rear transmission roller 19 and is also carried by transmission rollers 21 and 23 The endless conveyor belt 15 is driven between two transmission rollers 25 and 27, the latter being located closer to the exit than transmission roller 19 of the lower endless conveyor belt 13. Each of the endless conveyor belts 13 and 15 is made up of a plurality of spaced apart elements or tapes.

Figure 2:
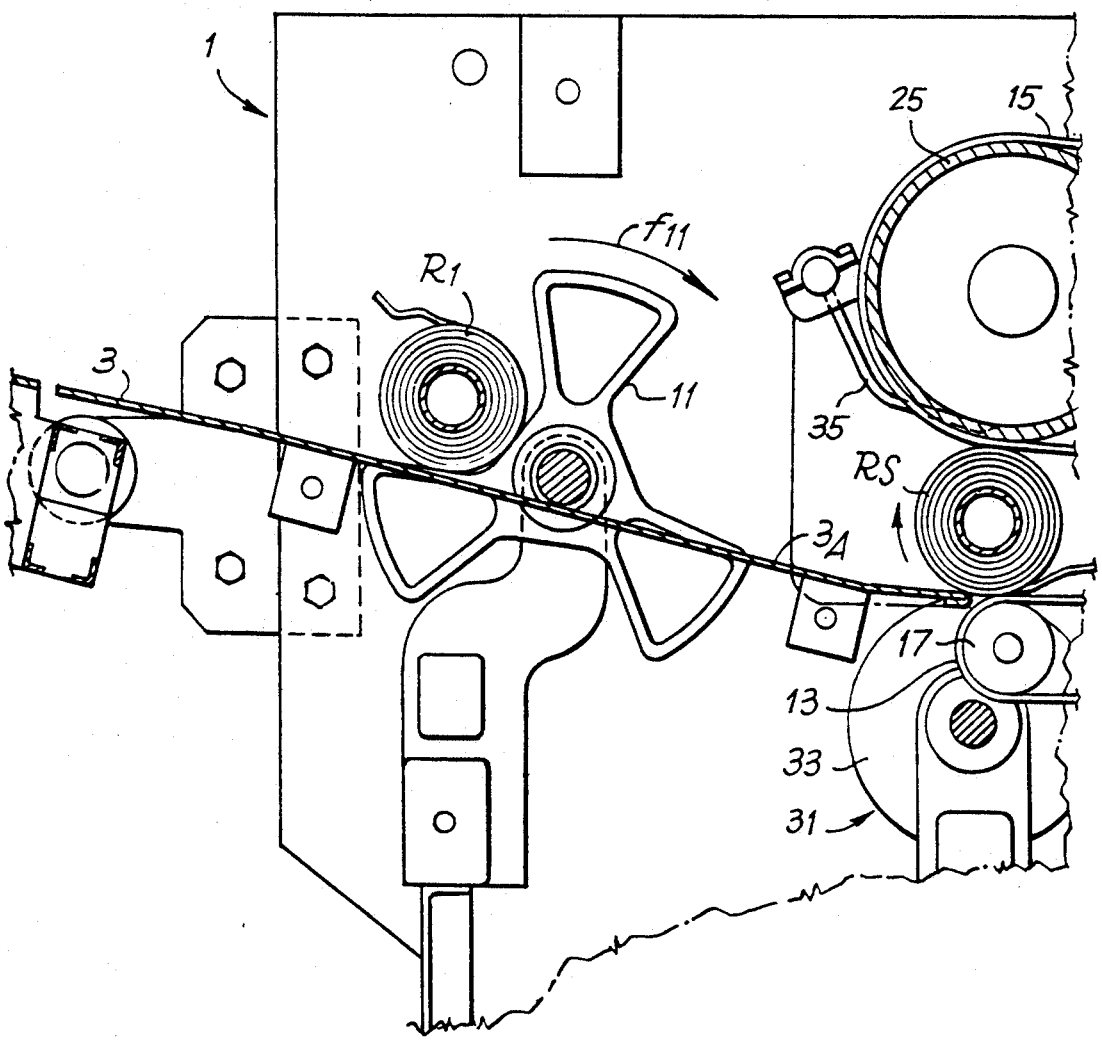
FIGS. 2, 3, 4 and 5 show enlarged details of FIG. 1.
Figure 6:
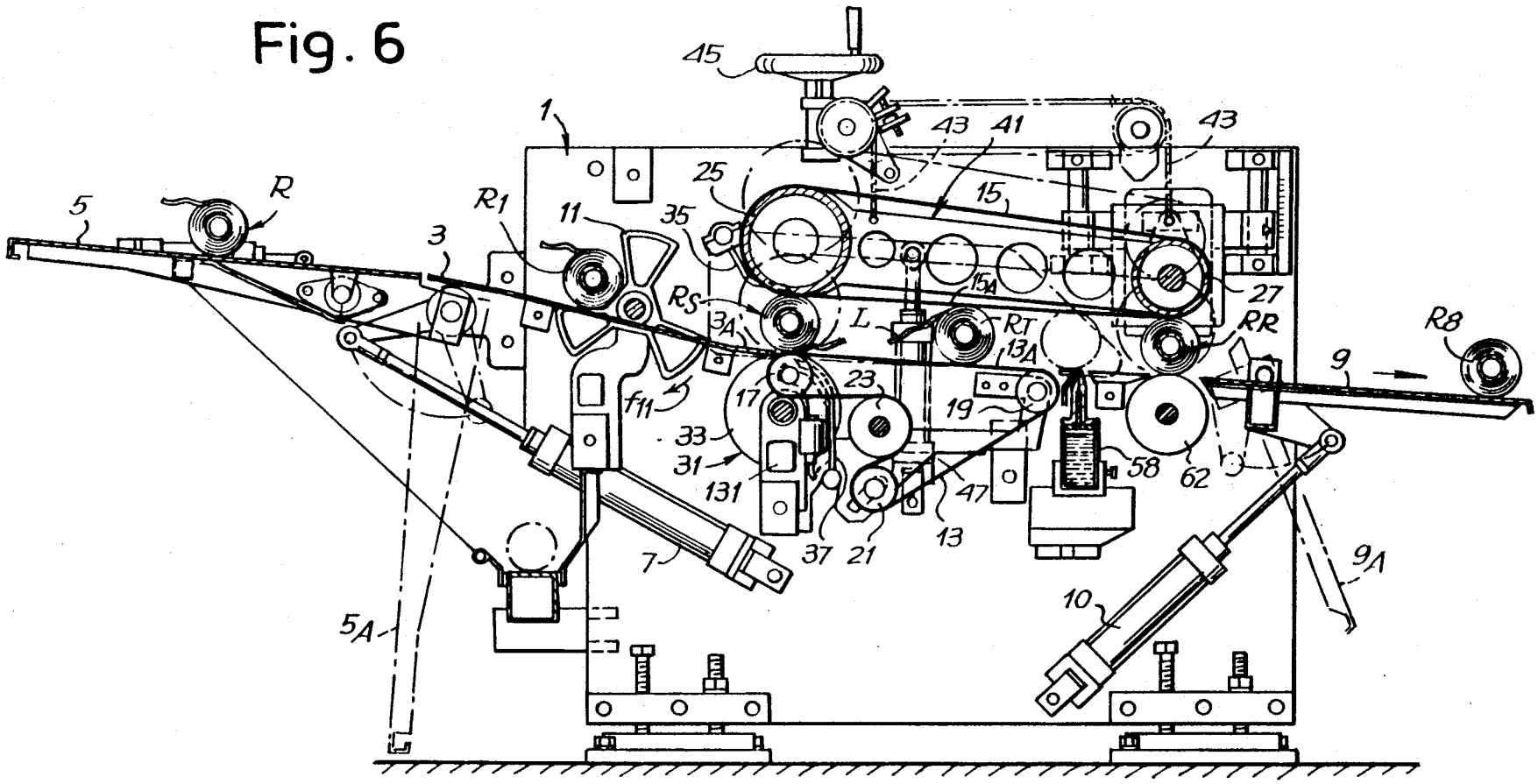
FIG. 6 is similar to FIG. 1 but shows a modified embodiment.
Figure 7:
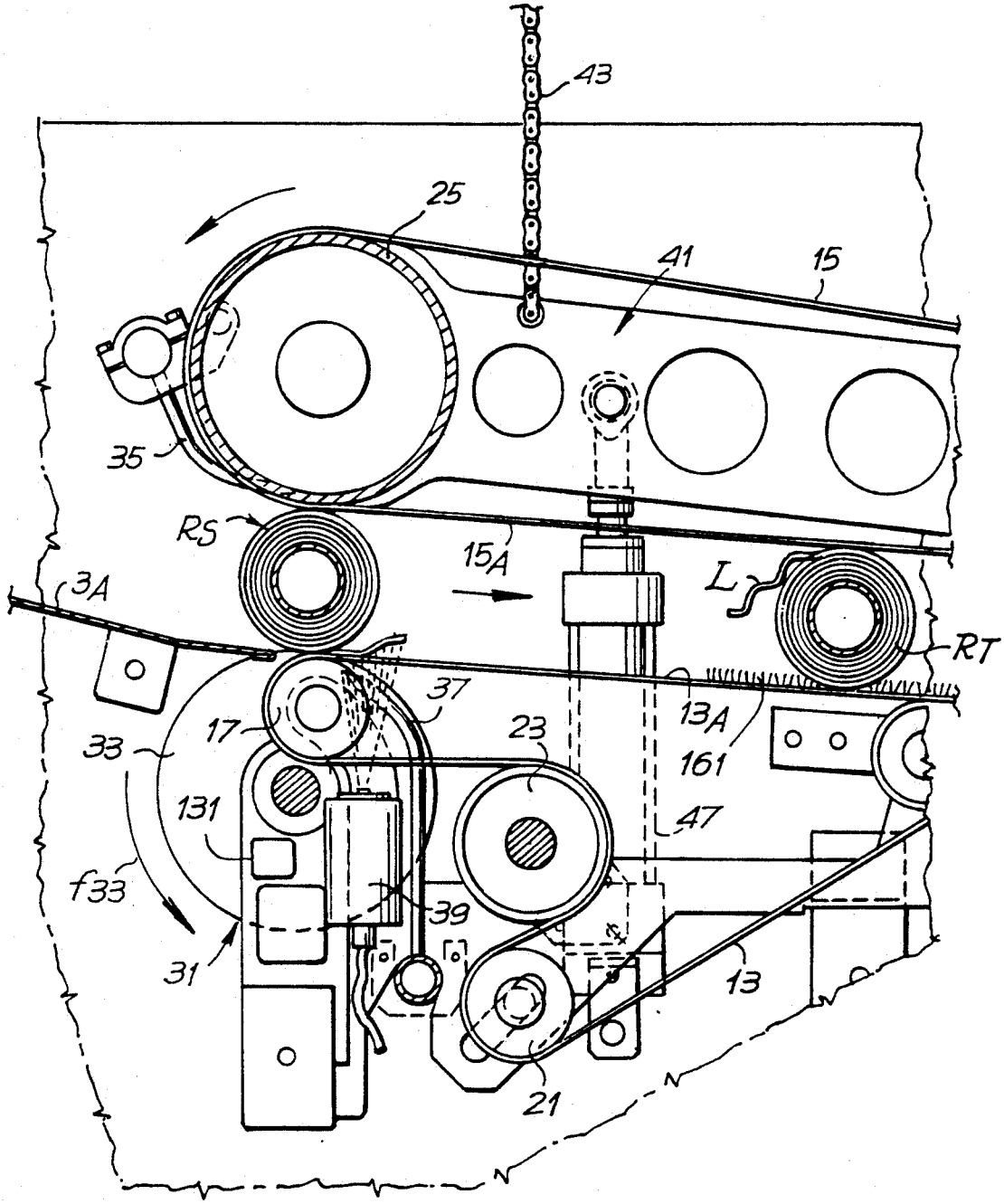
FIGS. 7 and 8 show enlarged details of FIG. 6.

As shown in FIG. 2, the log delivered by the rotor 11 rolls over the extension 3A of the inclined plane 3 and reaches a position RS (FIGS. 1 and 3) where its wound tail is unreeled. The position RS is located between the transmission roller 25 and the disks 33 of a group 31. The group 31 provides for unwinding the tail of the log at position RS and comprises a series of disks 33, whose axis lies approximately in the same vertical plane which contains the axis of the transmission roller 25. Between said disks 33, pulleys form sections of roller 17 on which the endless conveyor belt 13 is driven. The pulleys have their axis lying slightly downstream of the axis of disks 33. The disks 33 are intended to rotate in counter-clockwise direction as indicated by arrow f33 in FIG. 3. The group 31 for the unwinding of the tail L of incoming logs further includes blow nozzles which include an upper set of nozzles 35 arranged between sections of the upper conveyor belt 15 and located in grooves of the roller 25. An additional set of nozzles may be used, as shown in FIGS. 6 and 7 and indicated by 37. An optical sensor, including at least a photoelectric cell 39, (FIGS. 3 and 7) is designed to detect the end of the unwound tail and makes part of the group 31 as well.

The upper endless conveyor member 15, 15A, along with its transmission rollers 25 and 27, makes part of a unit 41 capable of being moved in a substantially vertical direction to adjust the interspace between the active branches 13A and 15A. This adjustment accommodates various diameters of logs R to be worked, and makes such interspace fit the diameter of the logs. To this end said unit 41 hangs down from chain members 43 which are operable simultaneously by a handwheel 45 or a suitable actuator so as to adjust the position of the unit 41 in vertical direction, along with its associated members such as the continuous conveyor 15 and the set of nozzles 35. The unit 43, 45 may be also arranged to change the inclination of branch 15A of the endless conveyor 15. Indicated by 47 is a pair of shock absorbers which are intended to reduce the weight of the front part of unit 1 to allow the machine to operate with logs of accidentally different diameter.

The flat belts forming the lower endless conveyor member 13 are permeable to air, and beneath the active branch 13A a suction box 51 is provided to produce a sucking effect on the free tail L which is unwound after the log rolled down the inclined plane 3 following delivery by the rotor 11. The suction box 51 also exerts a sucking effect through suitable channels along the path of the endless conveyor belt 13 driven around the transmission roller 19 (see hatched sections in FIGS. 3 and 4).

Figure 4:
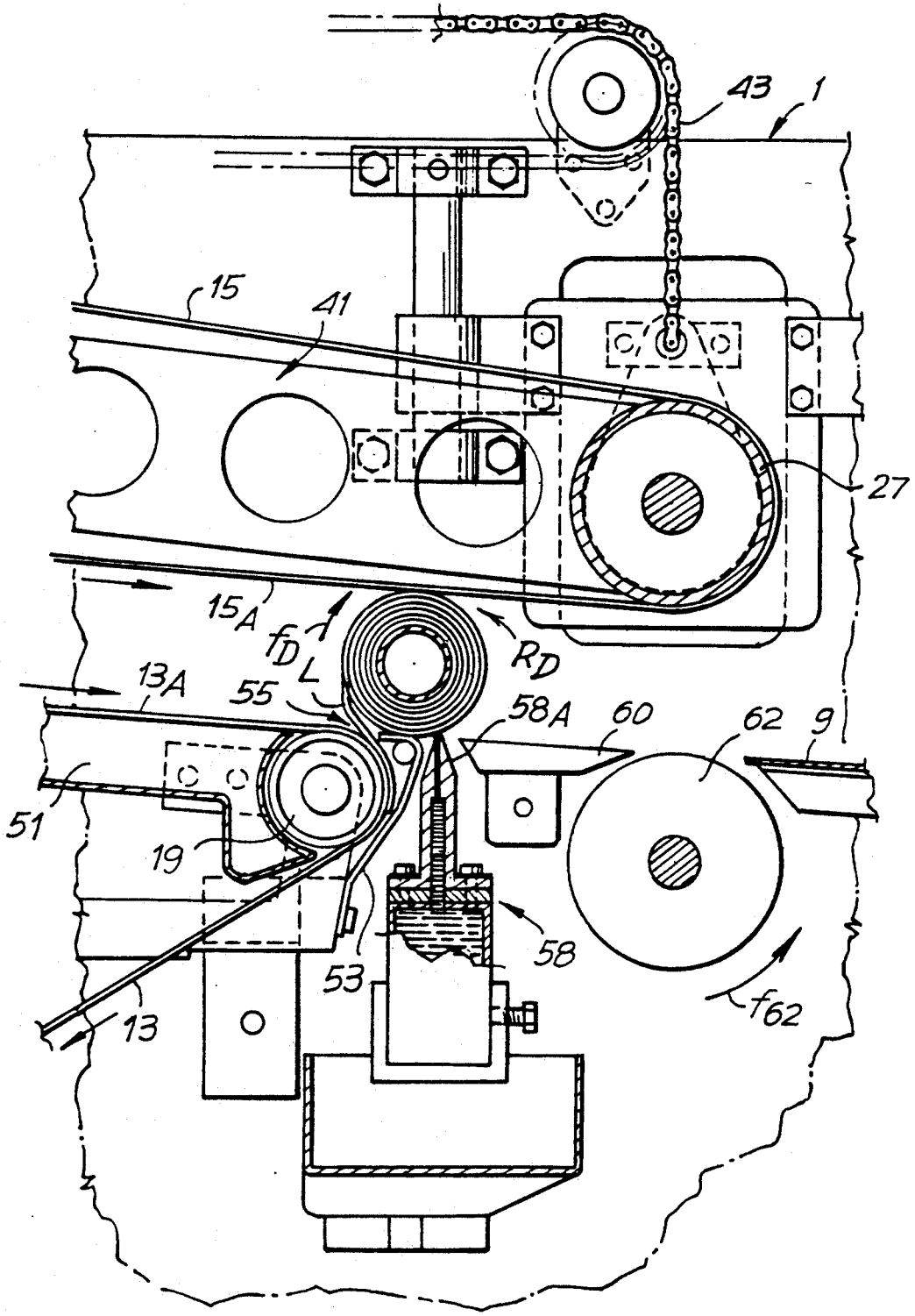
Figure 5:
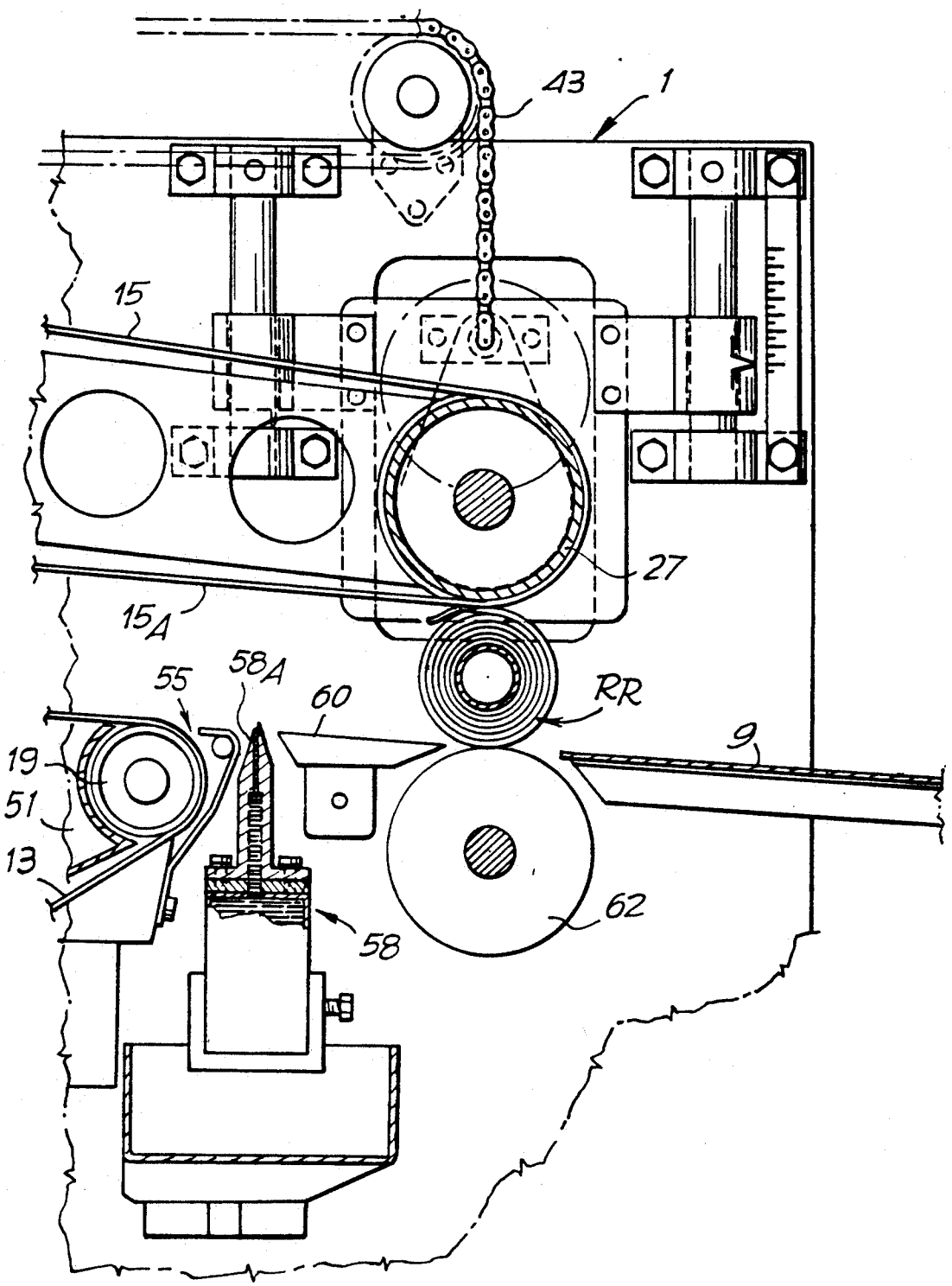

Just downstream of transmission roller 19 an end wall 53 is provided, flush with the active branch 13A and forming a continuation of this branch (FIG. 4). Said wall, together with the endless conveyor belt 13 driven on roller 19, defines an opening 55 extending transversely across the front of the machine. The opening 55 allows the tail L to enter an interspace defined between the endless belt 13, driven on the roller 19, and said end wall 53. The upper part of said wall 53 provides a surface across which the logs can roll.

Provided just downstream of wall 53 (see in particular FIG. 4) is a glue dispenser 58 arranged to apply a quick-setting glue, along a continuous or discontinuous line, onto the outer turn of the material wound on the advancing log, in order to retain the tail of said material in a manner indicated below.

The dispenser device 58 may be of a type providing a continuous overflowing-operated circulation of the glue, as disclosed in Italian Patent Application 9504 A/90 and European Application 91830427.0 and which, by reference, are included in the present application. In particular, the distributing section 58A of glue dispenser 58 (which glue is very fluid) is practically flush (slightly projecting) with respect to the rolling surface of the log reaching the position RD where the glue is applied. The distributing section 58A of the dispenser 58 is located in a slot defined by the end wall 53 and an adjoining shelf 60 which is an extension of the surface of the active branch 13A. Said shelf 60 lies below the terminal part of the active branch 15A which extends past the active branch 13A.

Just downstream of shelf 60 is a roller 62 (see also FIG. 5) which is flush to the trajectory of the log between the shelf 60 and the surface 9 for the exit of the log. Said roller 62 is located below the transmission roller 27 of the upper endless conveyor member 15. The roller 62, rotating in the direction of arrow f62, defines, together with the transmission roller 27, a station for the rewinding of the tail. This station is reached by the log in rewinding position, indicated at RR.

Figure 3:
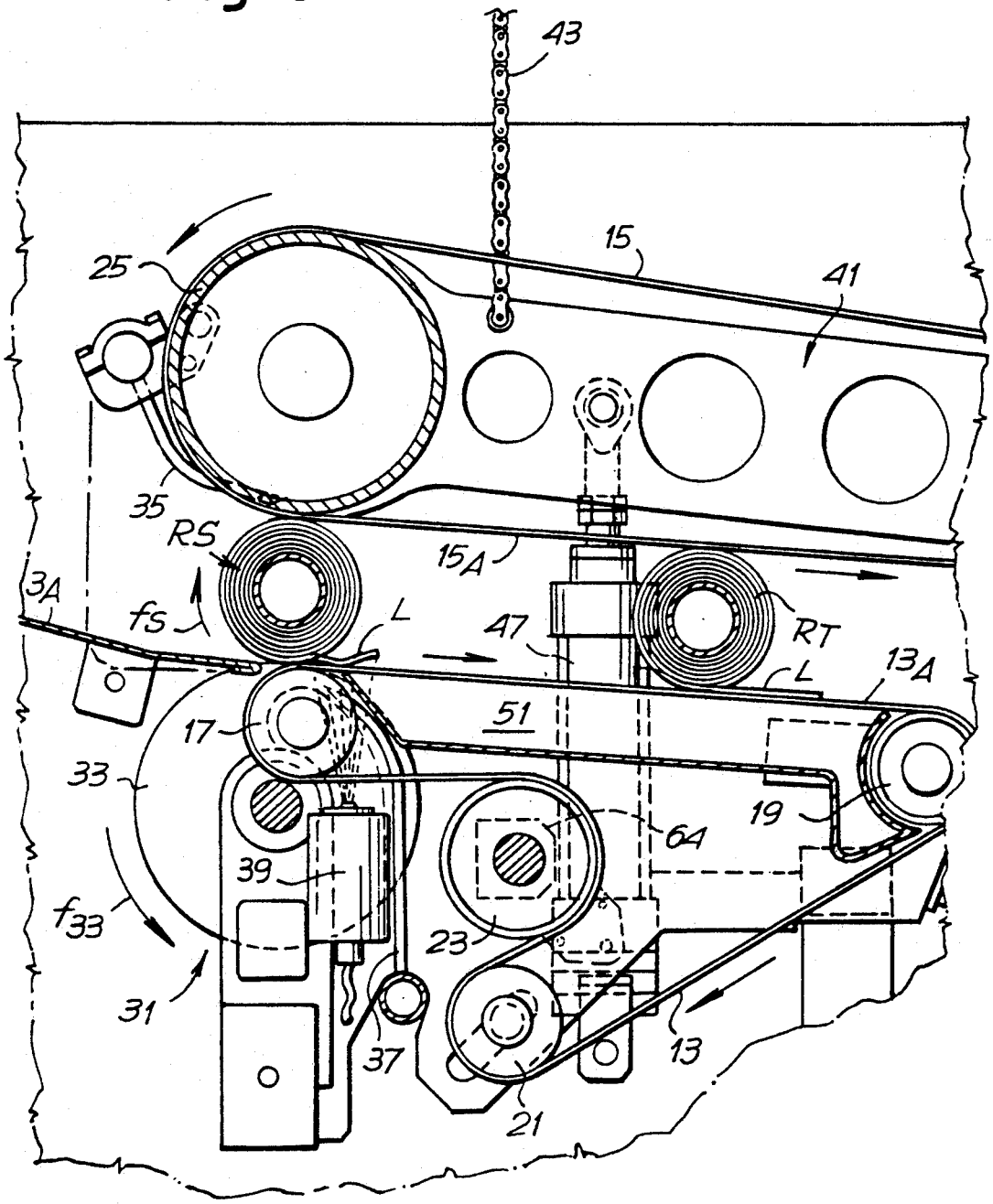

When the log R1 is released by rotor 11, it begins to roll along the surface 3A and reaches the position RS for the unwinding of the tail L. It then comes into contact with the upper endless conveyor member near the transmission roller 25, and with the disks 33 which rotate in the direction of arrow f33 at a peripheral speed equal and opposite to the advancement speed of the conveyor member 15A. Thus the log, at position RS, begins to rotate in the winding direction indicated by arrow fS, and the tail L is hit by the blows of air from the nozzles 35 (and 37 if provided). The tail starts to move away from the periphery of the log at position RS and to lie down and stretch out over the active branch 13A of the lower conveyor member 13, as shown in FIG. 3. Under these conditions, the tail L is controlled by the optical sensor represented by the photocell(s) 39 and tends to be rewound in the direction of arrow fS. When the tail L is shortened to an extent determined by the optical sensor 39, the latter cause the disks 33 to stop. In this way, the log at position RS, which was previously in contact with the upper conveyor member 15, 15A (and with the disks 33 rotating at equal and opposite speeds) is now driven into an initial rolling movement to move forward in the same direction as the active branches 13A and 15A of the conveyor belts 13 and 15. As soon as it moves away from position RS, the log loses its contact with the periphery of disks 33 and comes into contact with the active branch 13A of the lower conveyor member 13 while maintaining its contact also with the active branch 15A of the upper conveyor member 15. Consequently, as soon as the log leaves the position RS, it is engaged by the two active branches 13A and 15A and transferred to the successive positions, including the position RT indicated in FIG. 3. The tail L is retained against the upper surface of the active branch 13A by the suction operated by the suction box 51.

If the two endless conveyor members 13 and 15 move forward at the same speed in the direction shown by the arrows adjacent to the active branches 13A and 15A, the position and length of the tail L will remain unchanged. If, instead, the endless conveyor member 13 has a slightly greater advancement speed (which is controlled and suitably adjustable with respect to the upper endless conveyor member 15), then the tail L, which is kept against the active branch 13A of the conveyor member 13 by said suction, will tend to become longer by an extent which depends on the differential speed between the two active branches 13A and 15A. It is thus possible, by using a speed variator 64 (for example, coaxial with roller 3) to adjust at will the length of the tail L.

Tail L remains adherent to the branch 13A during the advancement of the log to the positions between the two active branches, and in particular the instantaneous position RT illustrated in FIG. 3. Under these conditions the log is advanced to the position RT, as well as the position RD (see FIG. 4). By the time the log has reached the position RD, its tail L is still retained by suction on the outer surface of the endless conveyor 13, and has entered the opening 55 and the interspace between the conveyor 13 and the wall 53, as shown in FIG. 4. The log RD has come into contact with the upper surface formed by the end wall 53 and has started a rolling phase which continues also onto the surface of shelf 60 by the effect of the contact action of the active branch 15A, which now causes the log to roll up to position RD and beyond said position RD.

In the position RD, the outer surface of the log, i.e., the outer layer of the material wound thereon, is moistened by the distributing section 58A of the dispenser 58 at a precisely predetermined position with respect to the edge of the tail L, whose length can be adjusted in the manner described above. By rolling towards and beyond position RD in the direction of arrow fD, the log itself exerts a rewinding action on the tail L which is thus rewound on the log and is brought into contact with the region wetted with glue by the dispenser 58, 58A, the region of contact being as close as desired to the edge of the tail.

By further rolling of the log onto the shelf 60, and then between rollers 27 and 62, the tail L is pressed against the glue which has been applied just near the end of the tail. The rewinding operation terminates, or is anyway completed, when the log is at the position RR (see FIG. 5), where the log remains temporarily engaged between the roller 62 and the driving roller 27 (possibly in contact with the endless conveyor 15, 15A). This causes the log to turn through several complete revolutions at position RR to ensure that the tail is safely adhered to the periphery of the log at position RR. The roller 62 rotates at a peripheral speed corresponding to the speed of the upper endless conveyor 15. As soon as the roller 62 is stopped or slowed down, the log is caused to roll from position RR onto the inclined plane 9 from which it spontaneously rolls away.

The operation on subsequently fed logs may take place each time a previous log has been discharged onto the plane for the moving away thereof, or it may start even before such discharging, since the upstream members may be actuated independently of the final operations carried out on the previously treated log.

In the solution so far described and illustrated in FIGS. 1 to 5, the tail L extends from the log, which moves forward between the active branches 13A and 15A of the two endless conveyors 13 and 15, said tail extending downstream of said log and being retained onto the active branch 13A by the sucking action of suction box 51. In the solution shown in FIGS. 6 to 8, an embodiment is provided in which the tail is behind the log as it moves forward between the two active branches 13A and 15A.

In FIG. 6 and following, the elements corresponding to those of the previously described embodiment are designated by the same references and do not require a specific description. The modification with respect to the previous embodiment consists in the absence of the suction box 51 and of the permeability to the air of the lower endless conveyor member 13, as well as in the presence of an end wall 153 which is not necessarily required to form an opening 55 but just a stationary surface as a continuation of the active branch 13A of the lower endless conveyor member 13. Also necessary is the provision of the set of lower nozzles 37.

Moreover, provision is made, within the group 31, for the presence or the activation of a timer, diagrammatically shown at 131 in FIG. 7, which delays the stopping of disks 33 (with respect to the previously described embodiment) when the photocells 39 have sensed the presence of the end of the tail partially rewound onto the log at position RS. In this case, therefore, the delay in stopping the disks 33 causes the tail, which has a controlled length, to pass the region of contact between the disks 33 and the log RS and to be placed rearwardly of the log at position RS. Accordingly, such tail L, in its intermediate positions along the space between the two active branches 13A and 15A (and thus also at the intermediate position RT instantaneously reached by the log) is placed behind the log rather than in front thereof, and in contact with the active branch 13 as it is the case in the previously described solution.

Figure 8:
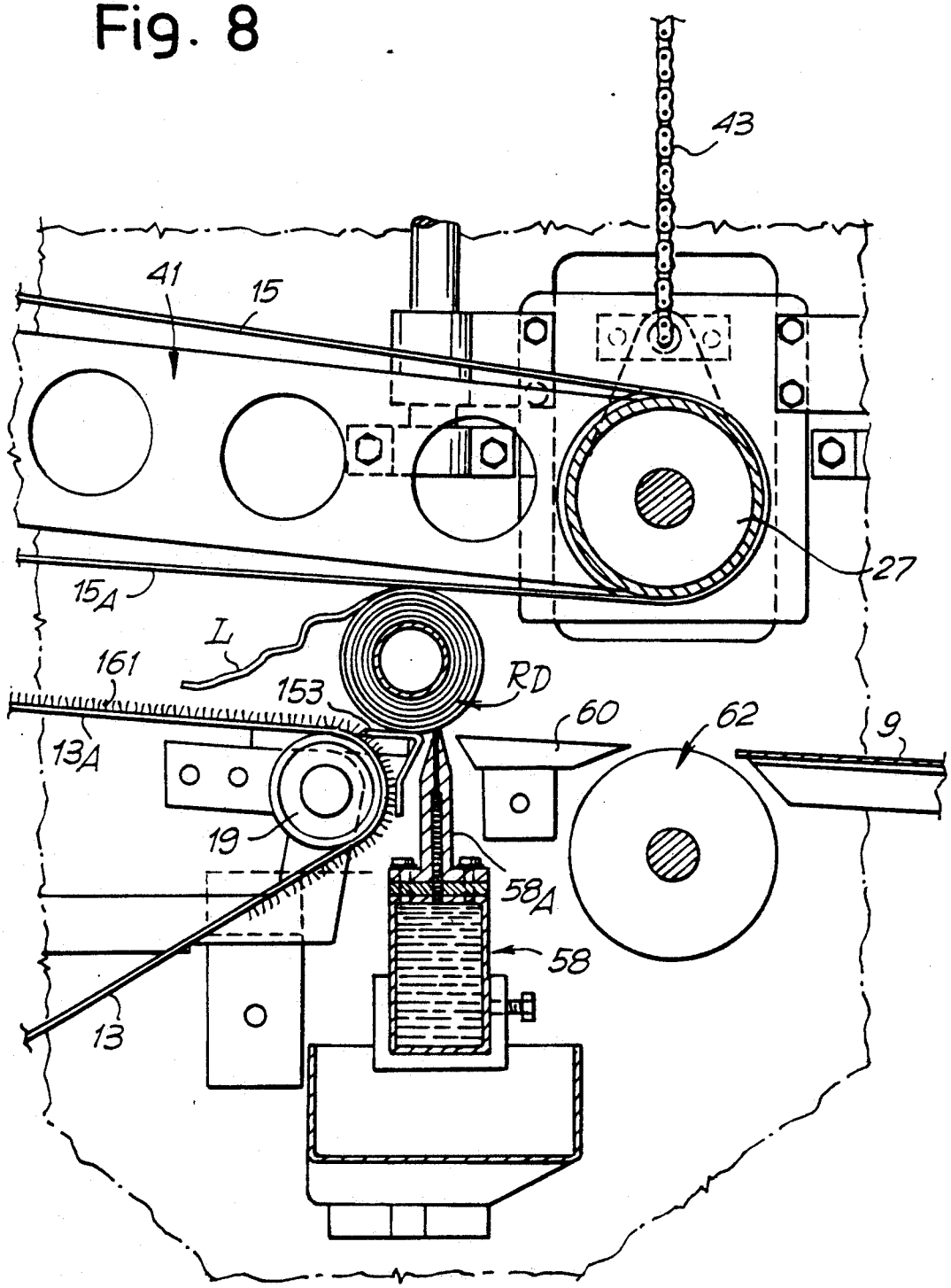

During the advancement of the log by means of the active branches 13A and 15A, and owing to differential speed between the two branches 13A and 15A and to the higher speed of the lower branch 13A, the tail L may be lengthened to such an extent as to reach position RD at a desired length, as shown in FIG. 8, where the tail L is loosely hanging behind the log. Between the various belts forming the conveyor 13 bristles may be provided like those shown at 161 (FIGS. 7 and 8) which keep the tail L raised to prevent it from bending down between the log and the conveyor belts.

The glue application performed by the dispenser 58, 58A, and the rolling of the log past the position RD on the shelf 60 until it comes into contact with the rotor 62, are similar to those already described for the previously disclosed embodiment and have the same result of causing the tail to lie down onto the surface of the log which has passed the position RD and reached the position RR. They are also similar in causing the end of the tail L to adhere to the periphery of the log at a region closely adjacent to the area where glue has been applied by the dispenser 58, 58A. The log is discharged, as previously described, on the inclined plane 9 for the exit thereof.

Depending on the diameter of the logs in course of formation, the space between the two active branches 13A and 15A can be modified by lifting and lowering the upper endless conveyor member 15A.

In addition to the above, the machine provides for special adjustment and high productivity at high operational speed as compared to prior art devices.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. In an apparatus for glueing the tail of a web of material forming a roll or log, which apparatus includes means for unwinding the tail of the material wound on the log, means for detecting the end of said tail, means for applying glue on the web material, said glue serving to adhere the end of the tail onto the log, means for rewinding the log and glueing the tail thereon, and means for moving said log; said apparatus characterized in that it includes:

a pair of endless conveyor members (13, 15) whose active branches (13A, 15A) are parallel and superimposed to each other and spaced apart an extent slightly less than the diameter of the rolls or logs (R) and moving forward in the same direction, the upper active branch (15A) being longer than the lower active branch 13A, a group (31) for unwinding the tail (L) of the material of the log (R), located upstream of said endless conveyor members (13, 15) able to control the position of the end edge of said tail (L) by a sensor (39);

a glue dispenser (58) downstream from the lower endless conveyor member (13) for dispensing glue from below onto the outer surface of the log, and a rewinding station (RR).

2. An apparatus according to the preceding claim, characterized in that it includes means (43, 45) to adjust the distance between the active branches (13A, 15A) of the pair of endless conveyor members (13, 15), which active branches extend substantially horizontally and are slightly convergent.

3. An apparatus according to claim 1 or 2, characterized in that it comprises means (47) which reduce the weight of the front part of the unit (41) of the upper conveyor (15).

4. An apparatus according to claim 2, characterized in that it comprises a unit (41) supporting the upper endless conveyor member (15), which is movable, and flexible means (43) of chain type or other, which are able to suspend said unit and move it parallel to itself and to change the inclination thereof.

5. An apparatus according to claim 3 characterized in that it comprises a unit (41) supporting the upper endless conveyor member (15), which is movable, and flexible means (43) of chain type or other, which are able to suspend said unit and move it parallel to itself and to change the inclination thereof.

6. An apparatus according to one or more of claims 1, 2, 4 or 5, characterized in that the two endless conveyor members (13, 15) can be operated with continuous motion at constant speed, the lower one (13) being movable slightly faster at an adjustable differential speed to achieve a controlled unwinding of the tail (L) and thus a desired distance between the glueing region and the end of the tail.

7. An apparatus according to one or more of claims 1, 2, 4 or 5, characterized in that said group (31) for unwinding the tail edge (L) includes disks (33) at a slightly upstream position with respect to the active branch (13A) of the lower conveyor member (13), against which the log which is rolling forward stops by coming into contact with the upper conveyor member (15), means for driving said disks (33) into rotation to make them rotate in such a direction as to rotate the logs and rewind the tail (L), blow nozzles (35, 37) for unwinding said tail (L), and control means with an optical sensor (39) which stop the disks at a predetermined time.

8. An apparatus according to one or more of claims 1, 2, 4 or 5 characterized in that it includes a suction box (51) located below the active branch (13A) of the lower endless conveyor member (13), which is permeable to air, to keep the tail (L) in front of the log moving forward along with the active branches (13A, 15A) of said endless conveyors (13, 15), and an end wall (53) forming an opening (55) extending along the driving roller (19) of said active branch (13A) and wherein the tail is inserted and from which said tail (L) is recovered by the active branch (15A) of said upper endless conveyor member (15) which makes the log to roll and to advance over the glue-dispensing means (58).

9. An apparatus according to one or more of claims 1, 2, 4 or 5 characterized in that it includes a timer (131) for delaying the stop of disks (33) and bringing the terminal edge (L) of the log to a rear position prior to its advancement between the active branches (13A, 15A) of the two endless conveyor members (13, 15), and bristles (161) or equivalent means being provided to avoid a wedging of edge (L) between the lower conveyor (13) and the log.

* * * * *